US007261581B2

(12) United States Patent
Henningsen

(10) Patent No.: US 7,261,581 B2
(45) Date of Patent: Aug. 28, 2007

(54) COAXIAL CONNECTOR AND METHOD

(75) Inventor: Jimmy Henningsen, Homegaard (DK)

(73) Assignee: Corning Gilbert Inc., Glendale, AZ (US)

( * ) Notice: Subject to any disclaimer, the term of this patent is extended or adjusted under 35 U.S.C. 154(b) by 57 days.

(21) Appl. No.: 10/725,695

(22) Filed: Dec. 1, 2003

(65) Prior Publication Data

US 2005/0118865 A1 Jun. 2, 2005

(51) Int. Cl.
*H01R 13/627* (2006.01)

(52) U.S. Cl. ..... 439/350

(58) Field of Classification Search ..... 439/583, 439/350, 354, 357, 353, 358
See application file for complete search history.

(56) References Cited

U.S. PATENT DOCUMENTS

| | | | | |
|---|---|---|---|---|
| 2,425,834 | A | 8/1947 | Salisbury | 174/88 |
| 2,449,983 | A | 9/1948 | Devol | 174/88 |
| 2,615,953 | A | 10/1952 | Waite | 174/88 |
| 3,040,288 | A | 6/1962 | Edlen et al. | 339/103 |
| 3,199,061 | A | 8/1965 | Johnson et al. | 339/100 |
| 3,291,895 | A | 12/1966 | Van Dyke | 174/88 |
| 3,320,575 | A | 5/1967 | Brown et al. | 339/268 |
| 3,678,446 | A | 7/1972 | Siebelist | 339/177 |
| 3,745,232 | A | 7/1973 | Johnson et al. | 174/107 |
| 3,757,279 | A | 9/1973 | Winston | 339/177 R |
| 3,829,800 | A | 8/1974 | Spinner | 333/97 |
| 3,907,399 | A | 9/1975 | Spinner | 339/177 |
| 3,963,321 | A | 6/1976 | Burger et al. | 339/177 |
| 4,046,451 | A | 9/1977 | Juds et al. | 339/177 |
| 4,126,372 | A * | 11/1978 | Hashimoto et al. | 439/583 |
| 4,135,776 | A | 1/1979 | Ailawadhi et al. | 339/177 |
| 4,236,188 | A | 11/1980 | Prochazka | 361/111 |
| 4,241,973 | A | 12/1980 | Mayer et al. | 339/143 |
| 4,268,957 | A | 5/1981 | Sbuelz | 29/871 |
| 4,346,958 | A * | 8/1982 | Blanchard | 439/584 |
| 4,408,822 | A | 10/1983 | Nikitas | 339/177 |
| 4,421,377 | A | 12/1983 | Spinner | 339/177 R |
| 4,456,323 | A | 6/1984 | Pitcher et al. | 339/177 |
| 4,496,208 | A | 1/1985 | Spinner et al. | 339/177 |
| 4,600,263 | A | 7/1986 | DeChamp et al. | 339/177 R |
| 4,687,272 | A | 8/1987 | Spinner et al. | 439/271 |
| 4,696,532 | A | 9/1987 | Mattis | 439/863 |
| 4,824,401 | A | 4/1989 | Spinner | 439/584 |
| 4,854,893 | A | 8/1989 | Morris | 439/578 |

(Continued)

FOREIGN PATENT DOCUMENTS

| | | |
|---|---|---|
| CH | 690 946 A5 | 4/1996 |

(Continued)

*Primary Examiner*—Phuong Dinh
(74) *Attorney, Agent, or Firm*—Marvin A. Glazer; Joseph M. Homa

(57) ABSTRACT

Disclosed is a coaxial connector consisting of a back nut, outer and inner terminals, and an insulator. The back nut is made of a single tubular piece and does not enclose any further parts. In connecting a coaxial cable to the connector, the cable is inserted through the back nut, and a portion of the outer conductor at the end of the cable is flared and shaped along a tapered clamping face of the back nut. The back nut is then axially displaced, as by threading the back nut over the outer terminal, to clamp the flared end of the outer conductor of the coaxial cable between the outer terminal of the connector and the back nut thereof.

10 Claims, 2 Drawing Sheets

U.S. PATENT DOCUMENTS

| | | | | | |
|---|---|---|---|---|---|
| 5,137,470 | A | | 8/1992 | Doles | 439/578 |
| 5,137,471 | A | | 8/1992 | Verespej et al. | 439/585 |
| 5,154,636 | A | * | 10/1992 | Vaccaro et al. | 439/583 |
| 5,166,477 | A | | 11/1992 | Perin, Jr. et al. | 174/74 R |
| 5,167,533 | A | * | 12/1992 | Rauwolf | 439/583 |
| 5,284,449 | A | | 2/1994 | Vaccaro | 439/583 |
| 5,354,217 | A | | 10/1994 | Gabel et al. | 439/583 |
| 5,518,420 | A | | 5/1996 | Pitschi | 439/578 |
| 5,595,502 | A | | 1/1997 | Allison | 439/429 |
| 5,651,698 | A | | 7/1997 | Locati et al. | 439/578 |
| 5,766,037 | A | | 6/1998 | Nelson | 439/583 |
| 5,795,188 | A | * | 8/1998 | Harwath | 439/583 |
| 5,830,009 | A | | 11/1998 | Tettinger | 439/578 |
| 5,857,872 | A | | 1/1999 | Tettinger | 439/584 |
| 5,871,372 | A | | 2/1999 | Kanda et al. | 439/583 |
| 5,984,723 | A | | 11/1999 | Wild | 439/583 |
| 5,993,254 | A | | 11/1999 | Pitschi et al. | 439/584 |
| 6,019,635 | A | | 2/2000 | Nelson | 439/583 |
| 6,019,636 | A | | 2/2000 | Langham | 439/584 |
| 6,027,373 | A | | 2/2000 | Gray et al. | 439/578 |
| 6,102,738 | A | | 8/2000 | Macek et al. | 439/584 |
| 6,133,532 | A | | 10/2000 | Lundback et al. | 174/88 |
| 6,148,513 | A | | 11/2000 | Schiefer et al. | 29/858 |
| 6,217,384 | B1 | | 4/2001 | Strasser et al. | 439/583 |
| 6,267,621 | B1 | | 7/2001 | Pitschi et al. | 439/584 |
| 6,383,019 | B1 | | 5/2002 | Wild | 439/578 |
| 6,513,244 | B1 | | 2/2003 | Andreescu | 30/90.2 |
| 6,607,398 | B2 | | 8/2003 | Henningsen | 439/578 |
| 6,793,529 | B1 | | 9/2004 | Buenz | 439/583 |
| 2003/0044606 | A1 | | 3/2003 | Iskander | 428/375 |
| 2005/0159043 | A1 | | 7/2005 | Harwath et al. | 439/578 |
| 2005/0159044 | A1 | | 7/2005 | Harwath et al. | 439/578 |

FOREIGN PATENT DOCUMENTS

| | | | |
|---|---|---|---|
| DE | 900 364 | | 12/1953 |
| DE | 1 905 182 | | 9/1970 |
| DE | 4020326 | A1 | 1/1992 |
| DE | 298 00 824 | | 4/1998 |
| EP | 0 757 408 | | 2/1997 |
| EP | 1 122 835 | | 8/2001 |
| EP | 1 148 592 | | 10/2001 |
| EP | 1 303 005 | A1 | 4/2003 |
| EP | 1 376 773 | | 1/2004 |
| EP | 1 028 498 | | 11/2004 |
| GB | 1 421 215 | | 1/1976 |
| GB | 2 298 971 | A | 9/1996 |
| WO | WO 2004/055943 | | 7/2004 |

* cited by examiner

COAXIAL CONNECTOR AND METHOD

CROSS-REFERENCE TO RELATED APPLICATION

This application claims the benefit of priority under 35 U.S.C. 517 365(a) of International Patent Application Ser. No. PCT/DK03/00473 filed on Jul. 4, 2003, designating at least one country other than the United States of America.

TECHNICAL FIELD

The present invention relates generally to a connector for coaxial cables and more particularly to a simplified coaxial connector and method of attachment of a cable to the coaxial connector.

BACKGROUND OF THE INVENTION

Current connectors on the market consist of a number of moving parts, typically a standard front end which consists of an inner terminal, an outer terminal, insulator and a moveable back nut which encapsulates a number of seals, retaining rings and the like. U.S. Pat. No. 6,133,532 shows one such connector, having a back nut which encapsulates three different moving parts (a locking device, guide surface and inner sleeve) as well as three separate O-ring seals. The large number of moving parts in the back nut portion complicates the fitting of a coaxial cable which usually requires the use of several specialized tools. Additionally, the risk of connector malfunctioning and mounting problems increases with a higher number of moving parts, since there is a greater chance that at least one part may be defective, missing or incorrectly attached.

Furthermore, due to the large number of moving parts encapsulated in the back nut of most conventional connectors, the outer conductor must be thoroughly cleared of all glue and adhesive material that may hinder or jam the parts during mounting and tightening, or a poor electrical connection may result. This process can prove to be quite difficult and time-consuming.

The manufacture and assembly of conventional connectors is also expensive in terms of time taken and material costs due to the number of parts enclosed in the back nut, which have to be manufactured and assembled.

Accordingly, it is an object of the present invention is to provide a simple, yet effective method of securely connecting a coaxial cable with either a corrugated or non-corrugated outer conductor to a coaxial connector.

A further object of the invention is to provide an economic and effective connector for coaxial cables.

A further object is to provide a connector having a simple design and a limited number of parts, thus reducing manufacturing expense and assembly time.

These and other objects of the present invention will become more apparent to those skilled in the art as the description of the present invention proceeds.

SUMMARY OF THE INVENTION

The present invention provides a connector consisting of a back nut, inner and outer terminals, and insulator. The back nut is made of a single tubular piece and does not enclose any further parts. In connecting a coaxial cable to the connector, the cable is inserted through the back nut, and a portion of the conductor at the cable's end is flared and shaped along the back nut. The back nut is then axially displaced to clamp the cable between an outer terminal of the connector and the back nut. This process is very simple and easy to carry out, while greatly reducing the chances of errors and defects in assembly and mounting in comparison to convention connectors.

The reduction in the number of parts also means that only an end portion of the outer conductor which comes into contact with the connector has to be stripped of glue and adhesive material. This is a much smaller area than required for conventional conductors.

According to one embodiment, the procedure for mount the connector to the cable includes the steps of a) removing the insulating jacket from the end of the cable which is to be connected; b) removing the dielectric material from the end of the cable to be connected; c) inserting the cable through the back nut; d) stripping any adhesive material from the portion of the cable's outer conductor; e) shaping the cable's outer conductor to conform to the back nut's inside circumference; f) placing the outer conductor's stripped end portion in a gap formed between the outer terminal's contact face and the back nut's abutting face; and g) longitudinally displacing the back nut in relation to the connector's front end until the end portion of the cables outer conductor is clamped between the corresponding faces of the connector outer terminal and back nut.

DETAILED DESCRIPTION OF THE INVENTION

Figure 1:
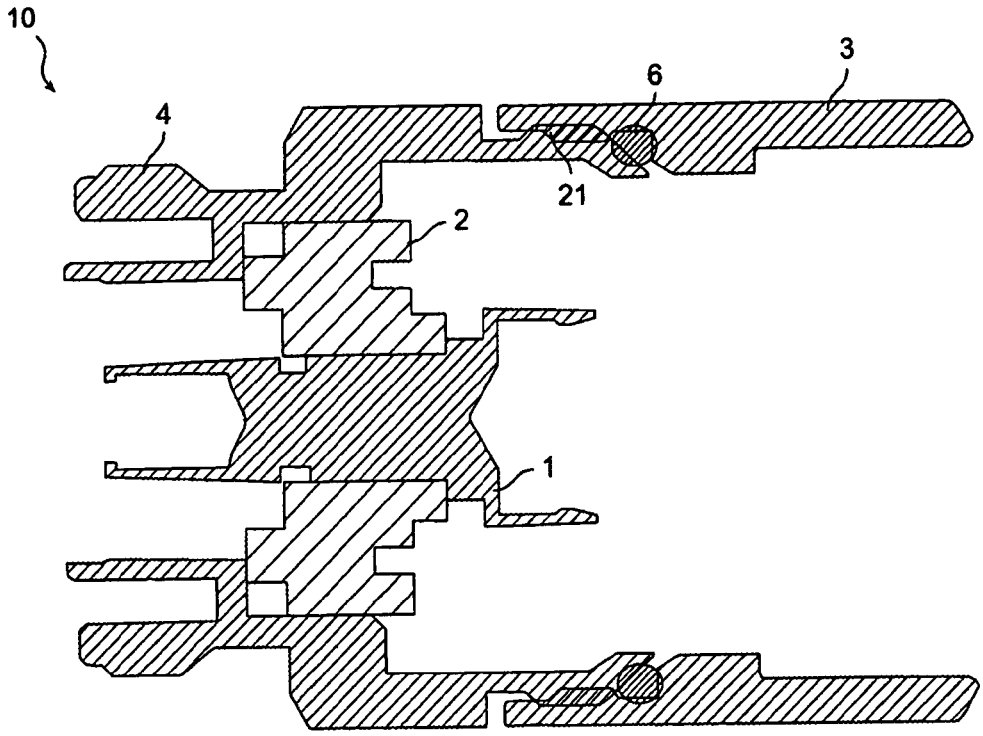
FIG. 1 is a sectional view of a connector, according to a preferred embodiment of the present invention.

FIG. 1 illustrates an embodiment of a connector 10 having an outer terminal 4, insulator 2 and inner terminal 1, which are rigidly attached to one another, and a back nut 3, which is rotatable and longitudinally displaceable along outer terminal 4, via mating threads 21. The inner terminal, back nut, and outer terminal are preferably made of brass. Other suitable materials include bronze for the inner terminal and plastic for the back nut. The insulator is press fit around the inner terminal and press fit into the outer terminal.

Figure 2:
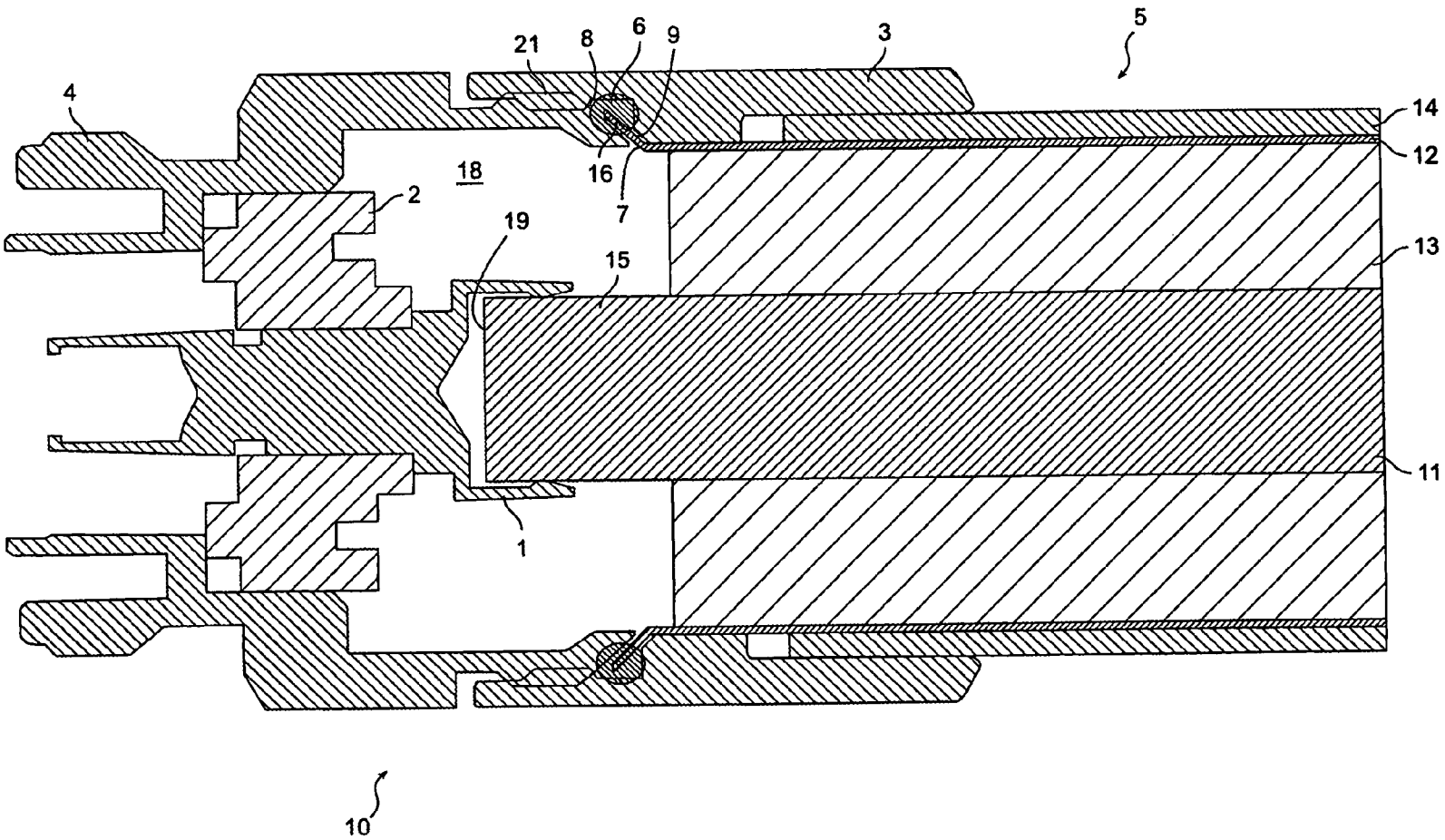
FIG. 2 is a sectional view of the connector of FIG. 1 mounted to a cable.

FIG. 2 illustrates connector 10 mounted to an end 19 of a cable 5, which includes inner and outer conductors 11 and 12, respectively, separated by a dielectric 13 and an outer insulating jacket 14. Outer conductor 12 is rigid, and may either be corrugated or smooth. An air space 18 is created between outer surfaces of the inner terminal and insulator, and inner surface of the outer terminal, and the end of the cable. This air space minimizes the loss through the connector at the connection between the connector and the cable, and provides about one-third the loss obtained with connectors having a corresponding dielectric filling.

In preparing cable 5 for mounting, a portion of the insulating jacket is removed from the end of the cable to expose a portion 7 of the outer conductor. A portion of the dielectric is then removed to expose a portion 15 of the cable's inner conductor. Also, the exposed outer conductor portion 7 is stripped and cleaned of any adhesive material that may have been used to secure the jacket about the outer conductor.

Connector 10 is shown with inner conductor portion 15 mounted and in contact with inner terminal 1, while the cable's stripped and cleaned outer conductor portion 7 is positioned in a gap 16 formed between abutting faces, 8 and 9, respectively, of the outer terminal 4 and the back nut 3, respectively. The cable receiving portion of the back nut, corresponding to face 9 is solid, not containing any slots or holes, in order to form a complete seal and make complete contact with the cable. The outer conductor portion 7 has been flared outwardly to create an enlarged-diameter lip after the exposed end of the cable has been inserted through the central aperture of the back nut. Outward flaring of the outer conductor may be produced by using a flaring tool for enlarging the diameter of the exposed end of the outer conductor. This flared end, or enlarged-diameter lip stops back nut 3 from slipping off the end of cable 5 and enables outer conductor portion 7 to be clamped in gap 16, as shown in the figure. The length of the flared portion of the outer conductor is preferably less than the diameter of the cable, and more preferably, less than half the diameter of the cable; ideally, the length of the flared portion is less than one-fourth the diameter of the cable. An O-ring 6 is located within an annular groove in the back nut. When back nut 3 is threaded over outer terminal 4, O-ring 6 is compressed between faces 8 and 9 to ensure that moisture does not enter between outer terminal 4 and back nut 3; moisture ingress often interferes with reliable electrical contact within the connector.

Figure 3:
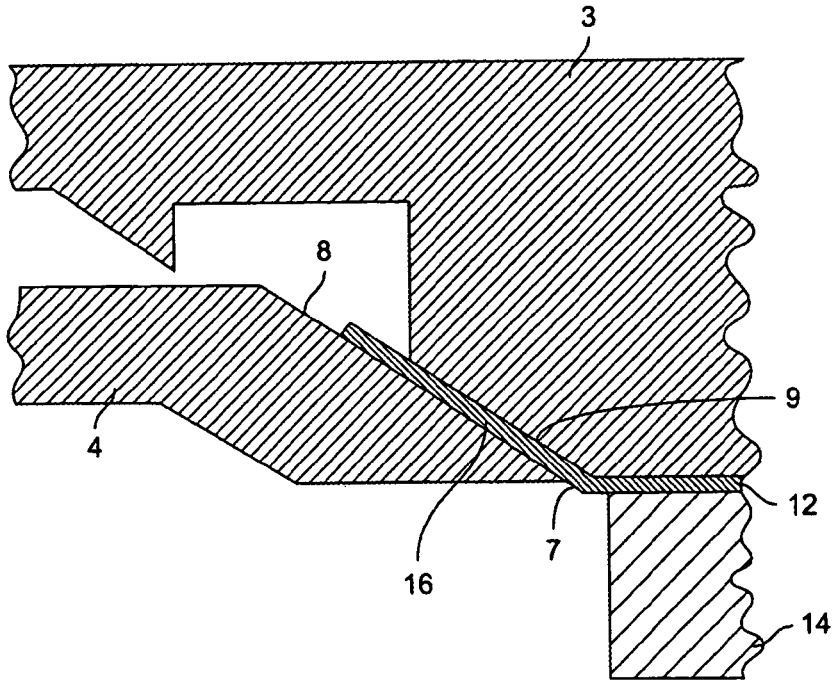
FIG. 3 is a view similar to FIG. 2, enlarged to show the attachment between an outer conductor portion of the cable and connector.

FIG. 3 is an enlarged view of the connection between the outer terminal 4 and back nut 3 (for clarity, O-ring 6 is not shown). As shown in FIG. 3, the end portion of outer conductor 12 is stripped of its jacket 14. As is also shown in FIG. 3, a portion of the dielectric material inside the coaxial cable has been removed to expose the inner surface of the outer conductor. As shown in FIG. 3, the end of outer conductor 12 has been flared to ensure that it may be inserted into the gap between corresponding faces 8 and 9. FIG. 3 shows end portion 7 of the outer conductor clamped between the back nut 3 and outer terminal 4, more specifically, between corresponding faces 8 and 9, ensuring a good mechanical connection, as well as a good electrical connection with the outer terminal's contact face 8. End portion 7 is compressed between back nut 3 and outer terminal 4 along the faces 8 and 9, which are angled, as shown in FIG. 3, such that the longitudinal displacement of the back nut toward the outer terminal (resulting from the tightening of back nut 3 over outer terminal 4) causes the outer conductor to be clamped. The frontmost portion of back nut 3 has internal threads formed therein; a corresponding portion of the outer terminal 4 has external threads formed thereupon for mating with the aforementioned internal threads of back nut 3.

Cable 5 is mounted as follows: first, the cable jacket 14 and dielectric material 13 is stripped off of the end of the cable to be connected. The cable is then inserted through the central aperture of back nut 3. The exposed end of outer conductor portion 7 is then flared outwardly to a diameter which exceeds the smallest inner diameter of back nut 3, using the flaring tool described above. Any adhesive or glue remaining on the flared end of outer conductor portion 7 is removed. The end 19 of inner conductor 15 of the coaxial cable is then inserted into inner terminal 1 of the connector, while simultaneously bringing flared outer conductor portion 7 into proximity with face 8 of outer terminal 4. Back nut 3 is then threadedly engaged over outer terminal 4 and screwed until there is a mechanical stop. The connector is now reliably secured to the end of the coaxial cable.

According to a second embodiment, the cable may be mounted without removing either the cable's jacket or dielectric. The steps for mounting, according to this method, are as follows: first, an end portion of the cable is inserted through back nut 3. A tool is then used to pry the end portion of the cable's outer conductor away from the dielectric and flare it outwardly, as mentioned above. The inner conductor of the coaxial cable is then inserted into inner terminal 1 of the connector as described above, and back nut 3 is screwed over outer terminal 4 until there is a mechanical stop, leaving the end portion of the cable securely clamped between faces 8 and 9 of the outer terminal 4 and back nut 3. The cable can be mounted according to this method as long as there is a sufficient contact between the outer conductor portion 7 and face 8 of outer terminal 4.

According to a third embodiment, the cable is mounted by removing the dielectric within the exposed end of the coaxial cable, but not the cable jacket. This is a combination of the two previous embodiments. The steps for mounting the cable are as follows: first, a sufficient amount of dielectric material is removed from the end portion of the cable. The exposed end of the coaxial cable is then inserted through the central aperture of back nut 3. The end of outer conductor portion 7 is again flared outwardly. The inner conductor 15 of the coaxial cable is then inserted into inner terminal 1 of the connector, as described above. The back nut 3 is then longitudinally displaced, as by screwing back nut 3 onto outer terminal 4, so that the flared outer conductor and adjoined insulating jacket are clamped securely between the outer terminal's contact face 8 and the abutting back nut face 9.

Those skilled in the art will note that the above-described connector is of extremely simple design and requires a minimal number of components. It will also be noted that the outer conductor of the coaxial cable is directly clamped between the outer terminal and back nut of the coaxial connector, without requiring additional clamp rings, collars or other like components. As a result of its simple design, the disclosed connector can be manufactured relatively inexpensively and may be installed to the end of a coaxial cable relatively quickly and reliably.

While the present invention has been described with respect to a preferred embodiment thereof, such description is for illustrative purposes only, and is not to be construed as limiting the scope of the invention. Various modifications and changes may be made to the described embodiment by those skilled in the art without departing from the true spirit and scope of the invention.

The invention claimed is:

1. A coaxial connector for attachment to a coaxial cable, the coaxial cable including an outer conductor, the outer conductor of the coaxial cable having a predetermined outer diameter, and the outer conductor of the coaxial cable having an inner surface and an opposing outer surface, the coaxial connector comprising:

an outer terminal having front and back opposing ends, the back end of said outer terminal including a first angled contact face integral with said outer terminal; and a back nut releasably attachable to the back end of said outer terminal and extending around the back end of said outer terminal, and axially displaceable with respect to said outer terminal, the back nut including a second angled contact face integral with said back nut, the back nut including an internal bore extending therethrough for allowing passage of the coaxial cable therethrough, at least a portion of the internal bore having a predetermined internal diameter commensurate with the predetermined outer diameter of the cuter conductor of the coaxial cable, wherein said first angled contact face and said second angled contact face form a clamping site therebetween, said clamping site being tightened as said back nut is axially displaced with respect to said outer terminal, wherein said first angled contact face has a length that is shorter than said predetermined internal diameter, and wherein said second angled contact face has a length that is shorter than said predetermined internal diameter, said first angled contact face directly engaging the inner surface of the outer conductor of the coaxial cable, and said second angled contact face directly engaging the outer surface of the outer conductor of the coaxial cable, and wherein the coaxial cable includes an inner conductor having an outer surface, and wherein the coaxial connector includes an inner terminal adapted to engage the outer surface of the inner conductor of the coaxial cable.

2. The connector of claim 1 wherein a mechanical connection between said cable and said connector is established via said clamping site.

3. The connector of claim 1, wherein the outer conductor of said cable is either corrugated or smooth.

4. The connector of claim 1 wherein the connector further comprises an insulator disposed between the inner terminal and the outer terminal, and wherein the inner terminal, the outer terminal, the insulator and the end portion of the cable define an air space therebetween.

5. A coaxial connector for attachment to a coaxial cable including an outer conductor, the outer conductor of the coaxial cable having a predetermined outer diameter and the outer conductor of the coaxial cable having an inner surface and an opposing outer surface, the coaxial connector comprising:

an outer terminal having front and back opposing ends, the back end of said outer terminal including a first angled contact face integral with said outer terminal;

a back nut releasably attachable to the back end of said outer terminal and extending around the back end of said outer terminal, and axially displaceable with respect to said outer terminal, the back nut including a second angled contact face integral with said back nut, the back nut including an internal bore extending therethrough for allowing passage of the coaxial cable therethrough, at least a portion of the internal bore having a predetermined internal diameter commensurate with the predetermined outer diameter of the outer conductor of the coaxial cable; and said first and second angled contact faces forming an angled gap therebetween for clamping a portion of the outer conductor of the coaxial cable therebetween, wherein said gap decreases as said back nut is axially displaced towards said outer terminal, and increases as said back nut is axially displaced away from said outer terminal, and wherein said first angled contact face has a length that is shorter than said predetermined internal diameter, and wherein said second angled contact face has a length that is shorter than said predetermined internal diameter, said first angled contact face directly engaging the inner surface of the outer conductor of the coaxial cable, and second angled contact face directly engaging the outer surface of the outer conductor of the coaxial cable, wherein the coaxial cable includes an inner conductor having an outer surface, and wherein the coaxial connector includes an inner terminal adapted to engage the outer surface of the inner conductor of the coaxial cable.

6. The method of claim 5 wherein the connector further comprises an insulator disposed between the inner terminal and the outer terminal, and wherein the inner terminal, the outer terminal, the insulator and the cable define an air space therebetween.

7. A method of attaching a coaxial connector to an end of a coaxial cable, the coaxial connector including a removable back nut, a center conductor and an outer body, the outer body comprising an integral clamping surface, the coaxial cable including an inner conductor, a dielectric surrounding the inner conductor, an outer conductor surrounding the dielectric, and a jacket surrounding the outer conductor, the jacket having an outer diameter, the outer conductor having opposing inner and outer surfaces, said method comprising the steps of:

a. preparing the end of the coaxial cable by:

i. removing a portion of the dielectric, outer conductor, and jacket from the inner conductor to expose a portion of the inner conductor extending beyond the end of the outer conductor;

ii. removing a portion of the jacket from the outer conductor to expose a portion of the outer surface of the outer conductor; and iii. removing a portion of the dielectric from within the end of the outer conductor to expose a portion of the inner surface of the outer conductor;

b. inserting the prepared end portion of the coaxial cable through a back nut of the coaxial connector;

c. flaring an end portion of said outer conductor to provide a flared portion having a length smaller than the outer diameter of the jacket;

d. engaging the exposed inner conductor of the coaxial cable with the center conductor of the coaxial connector;

e. placing the clamping surface of the outer body in close proximity to the flared portion of the outer conductor of the coaxial cable; and f. securing the back nut of the coaxial connector to the outer body of the coaxial connector to clamp the flared portion of the outer conductor of the coaxial cable between the clamping surface and the back nut of the coaxial connector, wherein the back nut comprises an integral second clamping surface, and wherein said step of securing the back nut of the coaxial connector to the outer body of the coaxial connector clammps the flared portion of the outer conductor of the coaxial cable between the clamping surface of the outer body and the second clamping surface of the back nut.

8. The method recited by claim 7 wherein said step of securing the back nut to the outer body includes the step of axially displacing the back nut, and the flared portion of the outer conductor of the coaxial cable, toward said outer body.

9. The method recited by claim 7 wherein:

a. the back nut includes a threaded surface;

b. the outer body includes a threaded surface adapted to mate with the threaded surface of the back nut; and c. the step of securing the back nut to the outer body includes the step of engaging the threaded surface of the back nut with the threaded surface of the outer body and rotating the back nut relative to the outer body to tighten the back nut onto the outer body.

10. The method of claim 7 wherein the connector further comprises an insulator disposed between the center conductor and the outer body, and wherein the center conductor, the outer body, the insulator and the end of the cable define an air space therebetween.

* * * * *